United States Patent [19]

Staggers et al.

[11] 4,440,568

[45] Apr. 3, 1984

[54] BORON ALLOYING ADDITIVE FOR CONTINUOUSLY CASTING BORON STEEL

[75] Inventors: John O. Staggers, Downingtown; Samir K. Banerji, Norristown; Michael J. Lalich, Downingtown, all of Pa.

[73] Assignee: Foote Mineral Company, Exton, Pa.

[21] Appl. No.: 279,079

[22] Filed: Jun. 30, 1981

[51] Int. Cl.[3] ..... C21C 7/00; C22C 30/00

[52] U.S. Cl. ..... 75/53; 75/57; 75/58; 75/123 B; 75/123 E; 75/123 M; 75/129; 420/417; 420/578; 420/580; 420/581

[58] Field of Search ..... 75/122, 123 B, 123 E, 75/123 M, 134 F, 134 S, 57, 58, 129, 135, 175.5, 124, 53, 123 L

[56] References Cited

U.S. PATENT DOCUMENTS

| | | | |
|---|---|---|---|
| 3,383,202 | 5/1968 | Lynch | 75/122 |
| 3,467,167 | 9/1969 | Mahin | 164/56 |
| 3,623,862 | 11/1971 | Spengler et al. | 75/57 |
| 4,233,065 | 11/1980 | Koul | 75/134 |
| 4,251,268 | 2/1981 | Willim | 75/58 |

OTHER PUBLICATIONS

Young, W. P. et al., "Casting of Quality Steel at Wisconsin Steel", *Open Hearth Proceedings*, 1968, pp. 127–132.

Farrell, J. W. et al., "Steel Flow Through Nozzles: Influence of Deoxidizers", *Electric Furnace Proceedings*, 1971, pp. 31–46.

"An Application Report from Molycorp", publication data about 1970.

*Primary Examiner*—R. Dean

*Attorney, Agent, or Firm*—Howson and Howson

[57] ABSTRACT

A boron alloying additive for continuous casting of boron steel having the desired hardenability without tundish nozzle blockage. The additive comprises 0.25–3.0% boron, 2.5–40% rare earth metals (RE), 6–60% titanium, and the balance iron. The additive may also contain silicon, calcium, manganese, and zirconium. In the additive the weight ratios of Ti to B and (Ti+RE) to B are 20:1–60:1 and 30:1–90:1, respectively.

31 Claims, 2 Drawing Figures

BORON ALLOYING ADDITIVE FOR CONTINUOUSLY CASTING BORON STEEL

BACKGROUND OF THE INVENTION

A family of steels with particular interest having special properties of its own is the boron steels. These steels are useful for applications having critical hardenability specifications, and advantageously exhibit uniform response to heat treatment, as well as good machinability, formability, and weldability.

The effects of boron on the hardenability of steel are similar to those obtained with such common alloying elements as manganese, chromium, nickel, and molybdenum, but, unlike these elements, only a minute amount of boron is required. Since boron is relatively plentiful in this country, in many instances it can replace the aforementioned alloying elements, many of which must be imported at considerable expense from countries where political unrest is commonplace, making at least some sources of supply uncertain.

To develop the maximum hardenability effect, boron must be present in the steel in elemental form. Since boron has a strong affinity for oxygen and nitrogen, these elements either must be removed or controlled for boron to have its full hardenability effect. Accordingly, it has been the general practice to add boron to steel with titanium and zirconium present to protect the boron from nitrogen, and aluminum to protect boron from oxygen. In addition to effecting deoxidation and providing protection of boron from oxygen, aluminum is an effective grain refiner in production of ingot cast fine-grained steel. However, aluminum or alumina residuals in the steel may be detrimental to surface quality and other desired properties in the cast steel.

In the past decade, particular interest has been given to casting of steel continuously into semi-finished shapes, such as slabs, blooms, and billets, since such procedure eliminates the ingot and primary mill stages of rolled steel production, thus providing important economic advantages.

In the continuous casting process, molten steel is poured from the ladle into a tundish containing one or more nozzles of highly refractory material, through which the molten metal flows in metered amounts to vertically extending water-cooled, open-ended molds. The solidified metal is supported and withdrawn from the molds by pairs of withdrawal rolls, following which the castings are cut into appropriate lengths.

Before being cast, the molten steel must be deoxidized sufficiently to prevent pin-holes from forming on the surface of the solidified shapes as they are cast. Such holes can weaken the thin solidified skin that is formed around the molten steel of the interior of the cast shape, increasing the opportunity for escape of molten metal therefrom and producing surface imperfections. The common deoxidizer for molten steel is aluminum.

In continuous casting of billets and blooms, the tundish nozzles usually have a diameter of less than 1.0". Aluminum-killed steels cause clogging of the tundish nozzles due to deposition of alumina therein formed during deoxidation and/or reoxidation. As the aluminum content of the steel increases above about 0.004%, the danger of tundish nozzle blockage increases, particularly in smaller diameter nozzles. Such clogging terminates the continuous casting operation, and as a result, the remainder of the heat must be cast in ingots or returned to the furnace. In either case, such procedure adds substantially to production costs.

According to U.S. Pat. No. 3,626,862, tundish nozzle clogging during continuous casting of steel can be prevented by deoxidizing the steel by addition thereto of one or more rare earth metals or compounds thereof other than the oxides. On the other hand, the literature indicates that one pound of rare earth metal per ton of steel caused blockage of tundish nozzles (7/32" diameter) in laboratory tests. See J. W. Farrell et al.: "Steel Flow Through Nozzles: Influence of Deoxidizers", *Electric Furnace Proceedings*, Volume 29, page 31 (1971).

SUMMARY OF THE INVENTION

Broadly, the invention resides in a novel boron alloying additive for steel which makes possible the continuous casting of boron steel having the desired hardenability without undesirable tundish nozzle blockage. This result was particularly surprising inasmuch as the additive contains a substantial amount of at least one rare earth metal and also of titanium, a metal also reported to contribute to the tundish nozzle blockage problem. See the article by J. W. Farrell et al., supra.

The boron alloying additive of this invention, in addition to containing small quantities of boron, contains as essential constituents substantial amounts of titanium and rare earth metals which protect the boron from nitrogen and oxygen. With the alloying additive of this invention, a steel containing on the order of 0.0005% to about 0.003% residual boron and on the order of about 0.035% to about 0.055% residual titanium with good hardenability effect can be made. The steel is fine-grained even in the absence of aluminum.

It is an object of this invention to provide a novel boron alloying additive for producing fine-grained steel having the desired hardenability.

It is another object of this invention to provide a novel boron alloying additive for use in the continuous casting of boron steel.

A further object of this invention is a novel process for the continuous casting of fine-grained boron steel having the desired hardenability.

These and other objects and advantages of this invention will become apparent from the following detailed description, examples, appended claims, and drawings, in which:

FIGS. 1 and 2 are graphs showing hardenability bands for two common boron steels, and hardenabilities of continuously cast steel obtained using alloying additives of this invention.

DETAILED DESCRIPTION OF THE INVENTION

Figure 1:
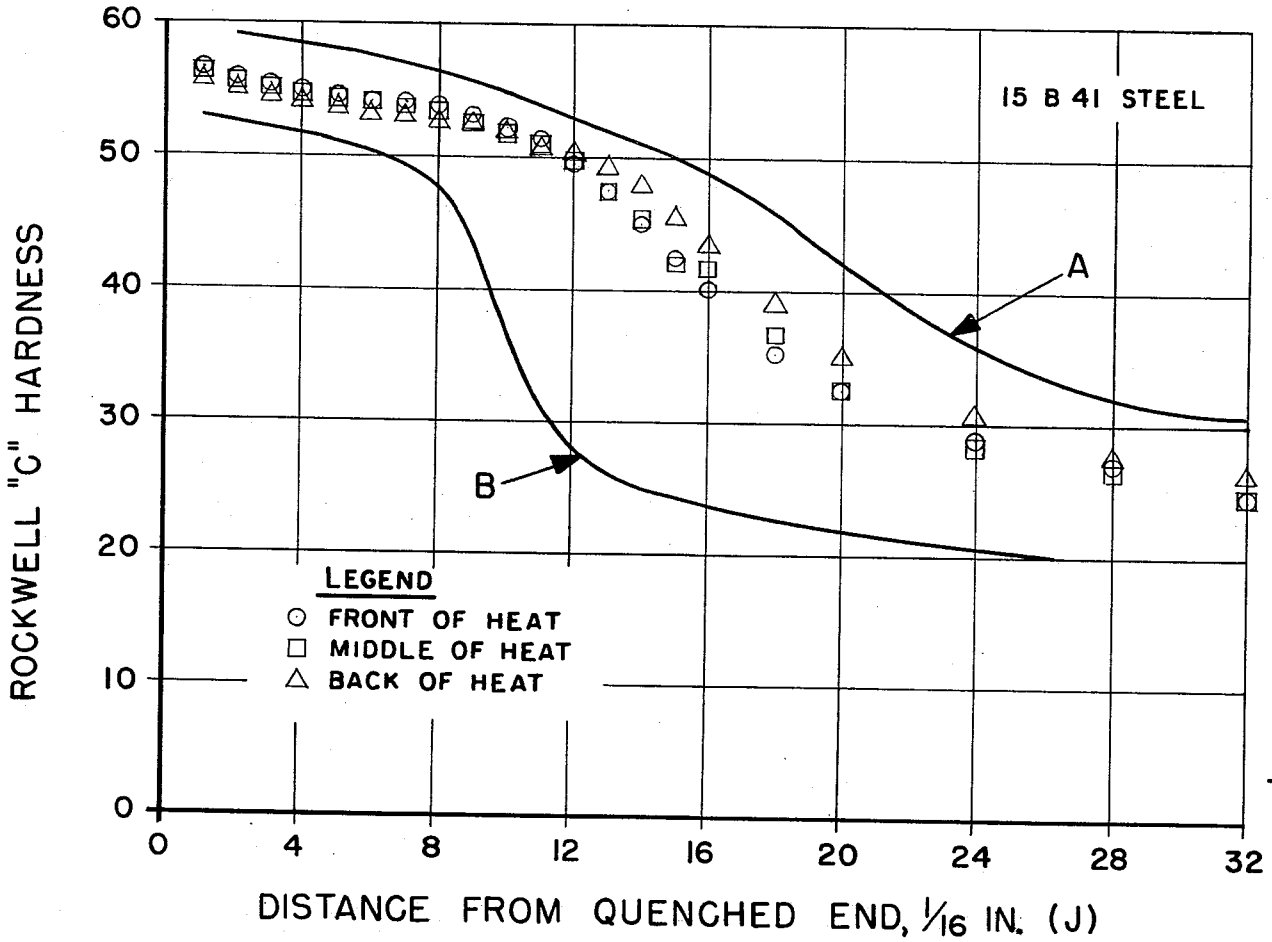

The novel boron alloying additive of this invention contains as essential constituents boron, at least one rare earth metal, titanium, and iron in specified proportions. However, the novel additive or alloy may also contain such elements as silicon, calcium, manganese, zirconium, and aluminum in specified limited amounts, depending upon the properties desired for the steel to which the alloy is added.

More particularly, the novel boron alloying additive may have the following composition:

TABLE I

| Elements | Weight Percent |
|---|---|
| Boron | 0.25–3.0 |

TABLE I-continued

| Elements | Weight Percent |
|---|---|
| Rare Earths | 2.5–40 |
| Titanium | 6–60 |
| Silicon | 0–75 |
| Calcium | 0–10 |
| Manganese | 0–10 |
| Zirconium | 0–5 |
| Aluminum | 0–2 |
| Iron | Balance to 100% |

provided, however, that the weight ratio of titanitnn to boron is in the range of from about 20:1 to about 60:1, and the weight ratio of titanium plus rare earths to boron is from about 30:1 to about 90:1.

Alloying additives of this invention which have been found to be particularly useful in continuous casting of boron steel contain about 0.3% to 1.5% boron, about 5% to 30% rare earth metal (RE), about 12% to 30% titanium, about 15% to 45% silicon, and the balance iron, to provide a total of 100%. In such alloys the Ti/B and (Ti +RE)/B weight ratios may be as stated above.

Particularly preferred alloying additives of this invention have the following composition:

TABLE II

| Elements | Weight Percent |
|---|---|
| Boron | 0.4–0.75 |
| Rare Earths | 6.0–15.0 |
| Titanium | 15.0–30.0 |
| Silicon | 20.0–40.0 |
| Calcium | 0–7 |
| Manganese | 0–8 |
| Zirconium | 0–5 |
| Aluminum | 0–2 |
| Iron | Balance to 100% |
| Ti/B weight ratio 25:1 to 50:1 | |
| (Ti + RE)/B weight ratio 35:1 to 70:1 | |

The alloying additives of this invention can be prepared by a variety of techniques, including submerged arc smelting, induction furnace melting, open arc refining, or a combination of any of the above methods with ladle addition modifications as required.

According to this invention, there has been developed a preferred method of ladle addition modification in combination with submerged arc smelting. In this method, a rare earth ferrosilicon alloy may be obtained by carbon (coal) reduction of a mixture of quartz and bastnasite ore or rare earth oxide, which reaction may be carried out in a stationary, carbon-lined, submerged arc smelting furnace. Iron scrap is added to the mix to provide the alloy with the desired iron content. The basic reactions between the carbon (coal), quartz, and bastnasite ore produce the elements silicon and rare earths (mainly cerium and lanthanum) with production of carbon monoxide, the reactions taking place at temperatures above about 3200° F. (1760° C.).

The resulting rare earth ferrosilicon alloy has the composition given in Table III, below:

TABLE III

| Element | Weight Percent | |
|---|---|---|
| | Broad | Preferred |
| Rare Earths | 10–50 | 12–15 |
| Silicon | 25–50 | 30–40 |
| Aluminum | 0–3.0 | 0–1.5 |
| Impurities other than Al | 0–3.0 | 0–1.5 |

TABLE III-continued

| Element | Weight Percent | |
|---|---|---|
| | Broad | Preferred |
| Iron | Balance to 100% | |

The molten rare earth ferrosilicon alloy of the above composition may be tapped into a ladle and there is then added thereto ferroboron, titanium scrap, and other elements as desired, in amounts to provide an alloying additive of the composition set forth in Tables I and II, above. Surprisingly, it was discovered that extremely large ladle additions of cold titanium scrap, e.g. as much as 65 percent by weight, based on rare earth ferrosilicon alloy, could be made to the molten alloy, and that by reason thereof, the alloying additives of this invention could be made in an extremely economical fashion. Preferably, about 50 to 60 percent of titanium is added to the molten intermediate alloy.

The rare earth metals which may be present in the alloying additives of this invention are listed in Table 1 which appears on page 145 of Volume 17 of Kirk-Othmer's *Encyclopedia of Chemical Technology, 2d,* and comprise Y, La, Ce, Pr, Nd, Pm, Sm, Eu, Gd, Tb, Dy, Ho, Er, Tm, Yb, and Lu. Because of the ready availability of bastnasite ore, which ore is rich in cerium and lanthanum, in preferred alloying additives of the present invention, these two elements generally will comprise the major portion of the rare earth metals, although there will also be present other rare earth metals in varying amounts.

As stated above, the essential elements of the novel alloy of this invention are boron, at least one rare earth metal, particularly cerium or cerium and lanthanum together, titanium, and iron. The amount of boron present in the alloy should not exceed about 3.0 percent; otherwise, the aforementioned ratios of titanium to boron and titanium plus rare earths to boron cannot be maintained. On the other hand, if the boron content of the additive is below about 0.25 percent, an excessive amount of the additive is required to provide a steel with the desired 0.0005 to 0.003 percent, preferably 0.001 to 0.002 percent, free boron. Such large amount of additive could upset the chemistry of the steel and add substantially to the cost.

Rare earth metals have a strong affinity for oxygen and nitrogen, and their use for deoxidizing steel has been suggested. However, as noted earlier, in laboratory tests, rare earths, when added to steel at the rate of 1 lb. per ton of steel, caused tundish nozzle blockage in continuous casting of the steel. Applicants discovered that if the rare earths are present in certain specified proportions in their novel boron alloying additive, these metals will protect the boron in the additive from reaction with oxygen in the steel. At the same time, it is believed that tundish nozzle blockage is avoided by formation of compounds resulting from reaction of rare earth oxides with titanium dioxide present in the steel, which compounds have a sufficiently low melting point to remain molten at steel casting temperatures. In addition, the rare earth metals may reduce the viscosity of the molten steel, thereby improving the continuous casting characteristics of the steel.

Titanium has a strong affinity for nitrogen, and in the additive of this invention acts as the primary element for protecting boron from nitrogen. As stated previously, there are published data to the effect that titanium caused tundish nozzle blockage in laboratory tests in continuous casting of steel. Advantageously, in the alloys of this invention, titanium, in the proportions indicated, does not cause such tundish nozzle blockage. As noted above, titanium dioxide is believed to form low-melting compounds by reaction with rare earth oxides. In addition, some of the titanium may produce other low-melting compounds by combining with other oxides present in the steel.

There is a definite relationship between the amounts of boron, rare earth metals, and titanium in the novel additive if the cast steel is to contain on the order of 0.0005 to 0.003 percent boron, and 0.035 to 0.055 percent titanium, which percentages of the respective elements are essential to provide the desired hardenability in most applications. Thus, the weight ratio of titanium to boron, and of titanium plus rare earth metals to boron, should be within the respective ranges recited hereinabove.

The additive of this invention may contain as optional constituents calcium, manganese, zirconium, and silicon.

Calcium provides additional deoxidation of the steel, and modifies residual alumina inclusions in the steel to relatively low-melting, innocuous calcium aluminates, which do not precipitate until the steel has passed through the tundish nozzles and begins to solidify in the mold. Calcium may also lower the viscosity of the steel. Thus, if the steel has not been treated with a compound such as calcium silicide, or calcium-barium silicide, prior to addition of the novel alloy of the invention, it may be desirable to include a limited amount of calcium, i.e. up to 10 percent, in the alloy.

Manganese, if present in the alloy, provides additional deoxidation of the steel, and thereby may provide indirect protection of boron from oxygen. Manganese may also improve dissolution of the alloy in the steel.

Zirconium, like titanium, has the ability to protect boron from nitrogen. Ordinarily, there will be sufficient titanium present in the additive to provide the necessary protection, thereby avoiding the need for zirconium to be present. Zirconium is considerably less effective than titanium in protecting boron from nitrogen, and thus a relatively high level of zirconium must be added to the steel to provide boron with the necessary protection from nitrogen. Such large quantity of zirconium makes the steel extremely difficult to cast continuously. Thus, primary protection of boron from nitrogen should be provided by titanium.

Silicon may provide secondary protection of boron from oxygen, and usually is present in the additive of this invention by reason of the method of manufacture of the additive from a ferrosilicon base (see the specific examples, infra). A relatively low level of silicon in the alloy is preferred, since such amount makes possible the addition of greater amounts of silicon to the steel in the furnace or ladle, thereby providing better deoxidation prior to addition to the steel of the boron alloying additive, resulting in improved properties as a result of the latter alloy.

In view of the fact that aluminum is known to be especially troublesome in causing tundish nozzle blockage in continuous casting of steel, particularly in the casting of billets and blooms, its presence in the additive of this invention is generally undesirable. However, by reason of certain raw materials used in the preparation of the alloy, the presence of aluminum in the alloy generally cannot be entirely eliminated. In any event, this element should not comprise more than about 2 percent of the additive.

The boron alloying additive of this invention is particularly useful in providing boron steel by the continuous casting process in small cross-section, semi-finished products, such as billets or blooms. Generally, the novel alloy is added to the steel in the ladle when the steel is being tapped from the furnace.

Prior to addition of the additive, the steel, which is generally a carbon steel containing on the order of 0.2 to 0.6 percent carbon, should be thoroughly deoxidized, and a low-nitrogen practice should be used during meltdown. By the term "deoxidized" is meant that the oxygen level of the steel has been reduced to the point where the rare earths in the additive can adequately protect boron from remaining oxygen in the steel, as well as that present due to reoxidation. The primary deoxidation can be achieved in one of several ways, e.g. by including sacrificial aluminum in the furnace; or by addition of silicon, manganese, rare earths, etc. to the molten steel. A combination of sacrificial aluminum with silicon and manganese can also be used. However, whenever aluminum is used for deoxidation, it should be sacrificial, i.e. all of the aluminum should be consumed in the deoxidation process and floated out as slag, such that not more that 0.004% residual aluminum remains in the steel going to the tundish, in order to avoid tundish nozzle blockage. Alternatively, the primary deoxidation can be achieved by using a sufficient amount of silicon in the furnace. Most boron steels now have a specification of 0.35% maximum for silicon. Accordingly it is recommended that about 0.3% silicon in the steel be the objective, with as much of the silicon being added in the furnace as is permissible, considering subsequent ladle additions.

A calcium-bearing material, such as calcium silicide or calcium-barium silicide, may be added in the ladle when it is less than $\frac{1}{4}$ full, and prior to adding the boron alloying additive of this invention. The amount of calcium-bearing material used depends on the calcium content in the boron alloying additive, if any, and the amount of the boron additive which is to be added subsequently. A total of about 1.25 lbs. of calcium may be added per ton of steel. The boron alloying additive of this invention is then added to the molten steel in the ladle. Once the entire heat has been poured into the ladle, a protective slag cover on the surface of the molten steel is recommended to prevent oxygen and nitrogen pick-up from the air.

Inert gas stirring (with the exception of $N_2$) is helpful to equilibrate the steel temperature in the ladle and to float out any undesirable potential nozzle clogging inclusions, especially if sacrificial aluminum has been used during deoxidation. Both stopper-rod and slide-gate arrangements can be used in the ladle. In the case of a slide-gate assembly, the nozzle well should be filled with some inert, free-flowing refractory, such as screened MgO ($8\times65$ mesh), to avoid any possible reaction with the reactive elements such as calcium and rare earths in the steel. This allows smooth opening of the slide-gate and trouble-free throttling when required.

The metal stream from the ladle to the tundish preferably should be protected with a ceramic shroud. Such a shroud minimizes the problems of reoxidation and build-up of harmful inclusions at the tundish nozzles as a result of reoxidation, improves the internal cleanliness of the steel, and minimizes heat loss by the steel in going from the ladle to the tundish. The tundish nozzle wells can remain open or be filled with calcium silicide to build a initial ferrostatic head in the tundish.

It is essential to preheat the ladle and the tundish as much as possible to minimize heat loss during transfer of the molten steel from one vessel to the other. This is important in order to maintain the steel temperature in the tundish at least 40°–50° F. (22°–27° C.) above the liquidus temperature of the steel to obtain smooth casting and to avoid freezing of the metal. A synthetic slag cover on the surface of the liquid steel in the tundish aids in minimizing heat loss and reoxidation problems. A liquid nitrogen shroud around the tundish-to-mold streams has been found to have no adverse effects. A ceramic shroud should prove to be beneficial.

The amount of boron alloying additive required will depend on such factors as the carbon and nitrogen content of the steel, and the residual boron, Effective Boron Factor (discussed below), and hardenability desired for the steel. Effective Boron Factors on the order of about 1.5 to about 2.5, depending upon carbon content of the steel, represent good boron hardenability. Such Effective Boron Factors can be obtained by adding to each ton of steel from about 6 to about 12 lbs., typically 7 to 8 lbs., of the preferred boron alloying additive of this invention. Usually, the boron alloying additive is added to the ladle when the ladle is approximately ¼ full, and the addition should be complete when the ladle is about ½ full.

A method generally considered reliable for isolating the effect of boron on hardenability is by determining the Effective Boron Factor (EBF) by means of the following equation:

$$EBF = \frac{D_I \text{ with boron (determined from actual Jominy test data)}}{D_I \text{ without boron (calculated from actual base chemistry and grain size)}}$$

where $D_I$ is the ideal diameter of an infinitely long cylinder which, in an ideal quench, will transform to a specific microstructure (50% martensite) at its center. An ideal quench is defined as one where the temperature of the surface of the test specimen (cylinder) attains the temperature of the quenching medium instantaneously.

The Jominy test is the most convenient and widely accepted test for determining the hardenability of any steel, and was developed by W. E. Jominy and A. L. Boegehold, *Trans ASM,* Volume 26, 1938 pages 574–599. This test, which has been designated ASTM A255, consists of heating a cylindrical specimen, 1" in diameter by 4" long, commonly referred to as a "Jominy bar", to a proper austenizing temperature, and then quenching it in such a manner that a stream of water impinges on only one end of the test bar. Two flat surfaces are then ground longitudinally in the specimen to a depth of at least 0.015", and hardness measurements are taken at 1/16" intervals from the quenched end. Frequently, the results are expressed in a curve of hardness values versus distance from the quenched end of the specimen (see FIGS. 1 and 2), although the hardness values can be tabulated in appropriate tables.

By use of the boron alloy of this invention, it is possible to produce by continuous casting fine-grained boron steels, especially billets and blooms, having excellent boron hardenability and good surface quality. Of course, the additives of this invention can be used to produce boron steel by ingot casting.

The following illustrative but non-limiting examples of this invention as it has actually been carried out will further inform those skilled in the art of the nature and utility thereof.

EXAMPLE I

A charge comprising a mixture of carbon (coal), quartz, bastnasite ore, boric oxide, and limestone was placed in a stationary, carbon-lined, submerged arc smelting furnace, where the charge was heated to a temperature above about 3200° F. (1760° C.), to provide an alloying additive having the approximate composition given in Table IV, below:

TABLE IV

| Element* | Weight Percent |
|---|---|
| Boron | 0.53 |
| Rare Earths | 10.33 |
| Titanium | 15.06 |
| Silicon | 35.56 |
| Calcium | 5.42 |
| Manganese | 3.95 |
| Aluminum | 1.48 |
| Iron | Balance |

*Also contained 1.5% carbon

In the additive, the weight ratio of titanium to boron was 28.4:1, and the weight ratio of titanium plus rare earths to boron was 47.9:1.

A large-scale plant trial was carried out using 225 lbs. of the additive of Table IV to make a 20 ton electric furnace heat of continuously cast 15B41 type boron steel, which amount of additive is the equivalent of 11.25 lbs. of additive per ton of steel. The procedure used is as hereinbelow described.

The steel was tapped at 3000° F. (1649° C.) after furnace addition of 400 lbs. of (high carbon) ferromanganese and 600 lbs. of silicomanganese. The tapping time was 2 min. 40 sec. 45 lbs. of calcium-barium silicide (2.25 lbs/ton steel) were added to the ladle at 25 sec. into the tap, followed by addition of 9 bags of the boron alloying additive of Table IV, each bag containing 25 lbs. of the additive sized approximately 1¼" by down. The boron alloy addition was complete 55 sec. after commencement of tapping. The temperature of the steel in the ladle was 2955° F. (1625° C.) upon arrival at the caster.

Prior to tapping, the well for the ladle nozzle (30 mm diameter) was filled with 8×65 mesh MgO refractory, which provided a trouble-free start for the molten metal stream from the ladle to the tundish, and no subsequent problems in pouring were encountered. The MgO also provided good control for slide-gate throttling when required. No problems were encountered in the continuous casting of this heat through three 0.532" diameter tundish nozzles to form 4½" square cross-section billets. The entire heat was cast in about 30 minutes with all the molten metal strands from the tundish nozzles casting at good speed. $N_2$ gas shrouds were used around the molten metal streams from the tundish to the molds. The surface quality of the billets was excellent. The chemical composition of the steel produced is given in Table V, below:

TABLE V

| Element | Weight Percent |
|---|---|
| Carbon | 0.39 |

TABLE V-continued

| Element | Weight Percent |
|---|---|
| Manganese | 1.47 |
| Phosphorous | 0.011 |
| Sulfur | 0.029 |
| Silicon | 0.35 |
| Copper | 0.19 |
| Nickel | 0.11 |
| Chromium | 0.09 |
| Titanium | 0.043 |
| Aluminum | 0.005 |
| Boron | 0.0010 |
| Nitrogen | 0.0072 |
| Iron | Balance |

The hardenability of the steel was measured by standard Jominy tests pursuant to ASTM A255 specifications, discussed above, using as test samples 2" thick longitudinal billet sections taken from the front, middle, and back of the heat, which sections were rolled to 1½" and machined to obtain Jominy bars. The Jominy bars were normalized at 1600° F. (871° C.) and end-quenched from 1550° F. (843° C.) according to the standard ASTM procedure. The hardenability data obtained have been plotted in FIG. 1. These data show that no fading or variation in hardenability occurred from the beginning to the end of the heat. Advantageously, all the hardenability data are in the upper half of the specified hardenability band for 15B41 steel, which lies between the solid lines A and B, FIG. 1 (see *Metal Progress Data Book,* Mid-June 1980, page 117), indicating excellent hardenability. The average Effective Boron Factor (EBF) is about 2.7 for an average grain size of about ASTM No. 9¼, thereby exceeding considerably the expected optimum EBF value of about 1.9 for this 0.39% C steel. Also, it is to be noted that the grain size of the steel produced is very fine, in the range of ASTM No. 8½–10, in spite of the fact that aluminum was not added to the steel in the continuous casting process.

EXAMPLE II

A rare earth ferrosilicon alloy having the approximate composition given in Table VI, below, was prepared by smelting in a stationary, carbon-lined, submerged arc furnace a charge consisting of a mixture of quartz, rare earth ore and oxides, carbon (coal), and iron:

TABLE VI

| Element | Weight Percent |
|---|---|
| Cerium and Other Rare Earths | 14 |
| Silicon | 37 |
| Aluminum | 1.5 |
| Other Impurities | 1.5 |
| Iron | Balance |

The foregoing alloy was divided into a number of separate portions, and each portion was heated to above about 3200° F. (1760° C.) in an induction furnace, and the resulting molten alloy was poured into a refractory-lined ladle which had been pre-heated to 1200° F. (649° C.). There was then added to the liquid metal in the ladle ferroboron (18% by weight boron) and titanium chips and scrap. In each instance the alloy was cast and crushed, and the several alloys so prepared were combined to obtain a boron alloying additive of this invention having the approximate composition given in Table VII, below:

TABLE VII

| Element | Weight Percent |
|---|---|
| Boron | 0.53 |
| Rare Earths | 9.17 |
| Titanium | 24.10 |
| Silicon | 26.00 |
| Aluminum | 0.85 |
| Iron | Balance |
| Ti/B weight ratio 45.5:1 | |
| (Ti + RE)/B weight ratio 62.8:1 | |

300 lbs. (i.e. 7.5 lbs./ton steel) of this alloying tive was used to make a 15B28 type steel in a 40 ton electric furnace. The primary deoxidation was achieved by furnace addition of 75 lbs. FeSi (50%), 660 lbs. high carbon FeMn, and 875 lbs. SiMn. The final chemistry of the steel after deoxidation was 0.26% carbon, 1.3% manganese, and 0.17% silicon. Ladle additions then were made in the following sequence:

TABLE VIII

| Time From Start of Tap into Ladle | Addition Made |
|---|---|
| 17 sec. | 2 bags of coke |
| 38 sec. | Start Cat—Ba silicide addition* |
| 45 sec. | Complete Cu—Ba silicide addition* |
| 45 sec. | Start addition of alloy of Table VII** |
| 1 min. 05 sec. | Complete addition of alloy of Table VII** |
| 2 min. 20 sec. | Tap complete |

*150 lbs. total
**12 bags at 25 lbs. each (300 lbs. total)

The temperature of the steel in the ladle at the caster (2 min. 38 sec. after tapping) was 2960° F. (1631° C.). An alumina-graphite ceramic shroud was used to protect the steel stream between the ladle and the tundish. Screened MgO was used in the ladle nozzle (30 mm diameter) well and provided trouble-free opening of the slide-gate to start the stream from the ladle to the tundish. A total of about 14 minutes elapsed after tapping before continuous casting from the sh to the molds began. Three 0.532" diameter tundish nozzles were used to continuously cast 4½" square billets. The casting process proceeded without difficulty, and the entire heat was cast in about 68 minutes, the molten metal streams from the tundish nozzles being $N_2$ shrouded. Casting speed was good, and the surface quality of the billets was excellent. The chemical composition of the steel produced is given in Table IX, below:

TABLE IX

| Element | Weight Percent |
|---|---|
| Carbon | 0.32 |
| Manganese | 1.31 |
| Phosphorous | 0.009 |
| Sulfur | 0.028 |
| Silicon | 0.26 |
| Copper | 0.20 |
| Nickel | 0.11 |
| Chromium | 0.20 |
| Titanium | 0.049 |
| Aluminum | 0.003 |
| Boron | 0.0014 |
| Nitrogen | 0.0092 |
| Iron | Balance |

Standard Jominy hardenability testing was performed on this steel as per ASTM A255 specifications using Jominy bars prepared from test samples from 2" thick longitudinal billet sections from the front, middle, and back of the heat, which sections were hot rolled to 1½" thickness prior to machining. The Jominy bars were normalized at 1650° F. (899° C.) and end-quenched from 1600° F. (871° C.) according to the standard ASTM procedure.

Figure 2:
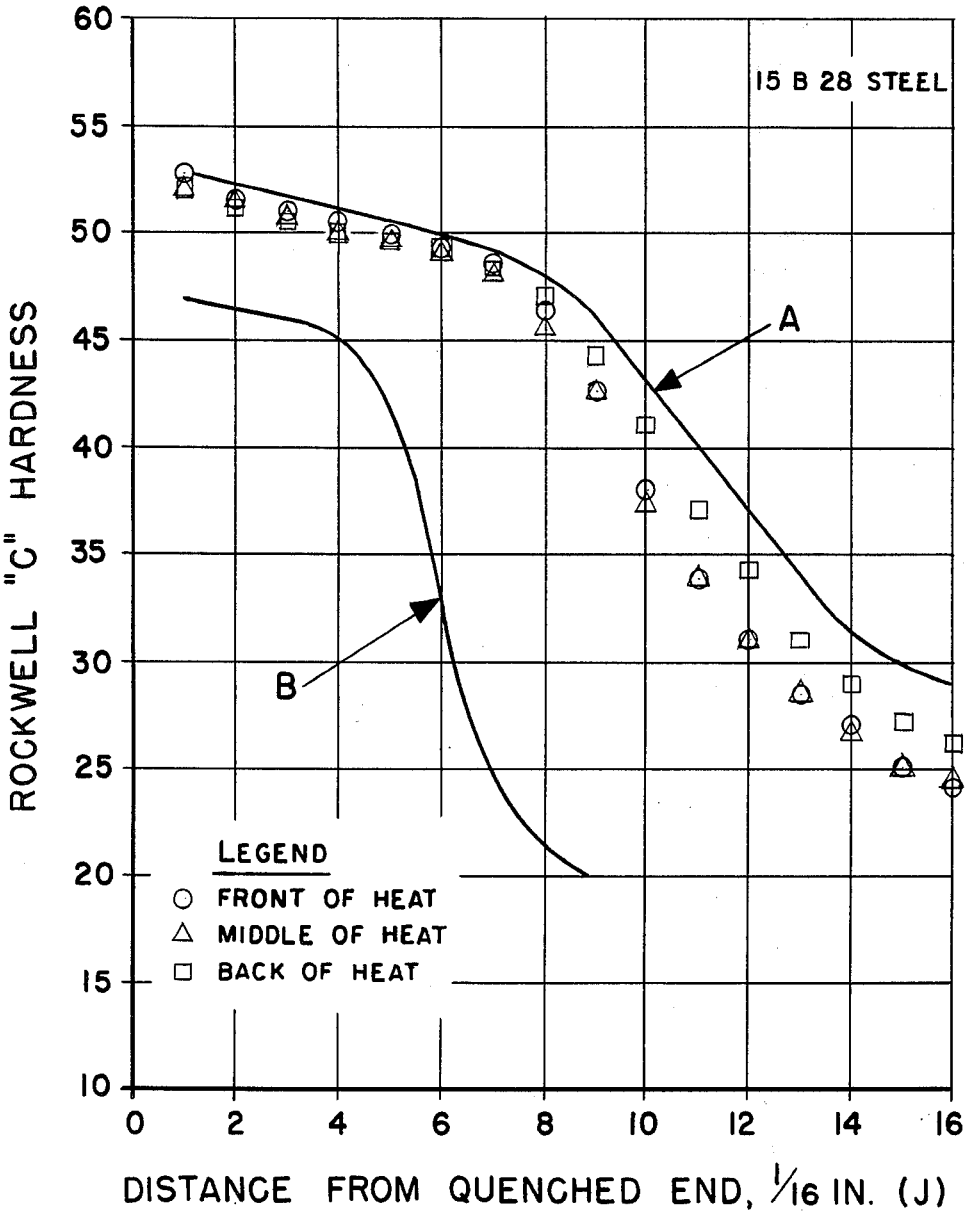

The hardenability results obtained from the front (circles), middle (triangles), and back (squares) of the heat are shown in FIG. 2. The hardenability of the steel throughout the entire heat was excellent, and all hardenability data fell near the top of the published 15B28H hardenability band, which lies between the solid lines A and B, FIG. 2 (see *Metal Progress Data Book,* Mid-June, 1980, page 117). An Effective Boron Factor (EBF) of about 2.5 was calculated for an average grain size of ASTM No. 9, which exceeds the optimum EBF of 2.1 expected for a 0.32% C steel of this type. A very fine-grained steel, with an average grain size of ASTM No. 9, and having good surface quality, was produced.

What is claimed:

1. A boron alloying additive particularly useful in the continuous casting of boron steel consisting essentially of from about 0.25 to about 3.0 percent boron, from about 2.5 to about 40 percent of at least one rare earth metal, from about 6 to about 60 percent titanium, up to about 75 percent silicon, up to about 10 percent calcium, up to about 5 percent zirconium, up to about 10 percent manganese, up to about 2 percent aluminum, and the balance iron, said percentages being by weight, based on the total weight of said additive, and the weight ratio of titanium to boron being from about 20:1 to about 60:1, and the weight ratio of titanium plus rare earth metal to boron being from about 30:1 to about 90:1.

2. A boron alloying additive according to claim 1 in which said rare earth metal comprises cerium.

3. A boron alloying additive according to claim 1 in which said rare earth metal comprises a combination of cerium and lanthanum.

4. A boron alloying additive particularly useful in the continuous casting of boron steel consisting essentially of from about 0.3 to about 1.5 percent boron, from about 5 to about 30 percent of at least one rare earth metal, from about 12 to about 30 percent titanium, from about 15 to about 45 percent silicon, up to about 10 percent calcium, up to about 10 percent manganese, up to about 5 percent zirconium, up to about 2 percent aluminum, and the balance iron, said percentages being by weight, based on the total weight of said additive, and the weight ratio of titanium to boron being from about 20:1 to about 60:1, and the weight ratio of titanium plus rare earth metal to boron being from about 30:1 to about 90:1.

5. A boron alloying additive according to claim 4 in which said rare earth metal comprises cerium.

6. A boron alloying additive according to claim 4 in which said rare earth metal comprises a combination of cerium and lanthanum.

7. A boron alloying additive particularly useful in the continuous casting of boron steel consisting essentially of from about 0.4 to about 0.75 percent boron, from about 6 to about 15 percent of at least one rare earth metal, from about 15 to about 30 percent titanium, from about 20 to about 40 percent silicon, up to about 7 percent calcium, up to about 8 percent manganese, up to about 5 percent zirconium, up to about 2 percent aluminum, and the balance iron, said percentages being by weight, and the weight ratio of titanium to boron being from about 25:1 to about 50:1, and the weight ratio of titanium plus rare earth metal to boron being from about 35:1 to about 70:1.

8. A boron alloying additive according to claim 7 in which said rare earth metal comprises cerium.

9. A boron alloying additive according to claim 7 in which said rare earth metal comprises a combination of cerium and lanthanum.

10. A boron alloying additive particularly useful in the continuous casting of boron steel consisting essentially of about 0.53 percent boron, about 9.17 percent of at least one rare earth metal, about 24.10 percent titanium, about 26.0 percent silicon, up to about 0.85 percent aluminum, and the balance iron, said percentages being by weight based on the total weight of said additive, and the weight ratio of titanium to boron being about 45.5:1, and the weight ratio of titanium plus rare earth metal to boron being about 62.8:1.

11. A boron alloying additive for steel according to claim 10 in which said rare earth metal comprises a combination of cerium and lanthanum.

12. A boron alloying additive particularly useful in the continuous casting of boron steel consisting essentially of about 0.53 percent boron, about 10.33 percent of at least one rare earth metal, about 15.06 percent titanium, about 35.56 percent silicon, about 5.42 percent calcium, about 3.95 percent manganese, up to about 1.48 percent aluminum, and the balance iron, said percentages being by weight, based on the total weight of said additive, and the weight ratio of titanium to boron being about 28.4:1, and the weight ratio of titanium plus rare earth metal to boron being about 47.9:1.

13. A boron alloying additive for steel according to claim 12 in which said rare earth metal comprises a combination of cerium and lanthanum.

14. A method for the continuous casting of boron steel which comprises adding to the molten steel at least one addition agent having a high affinity for oxygen present in the steel in an amount sufficient to deoxidize the steel, introducing the deoxidized steel to a tundish provided with a nozzle through which the steel is continuously cast into a mold, and adding to the deoxidized steel prior to casting a boron alloying additive consisting essentially of from about 0.25 to about 3.0 percent boron, from about 2.5 to about 40 percent of at least one rare earth metal, from about 6 to about 60 percent titanium, up to about 75 percent silicon, up to about 10 percent calcium, up to about 5 percent zirconium, up to about 10 percent manganese, up to about 2 percent aluminum, and the balance iron, said percentages being by weight, based on the total weight of said additive, and the weight ratio of titanium to boron being from about 20:1 to about 60:1, and the weight ratio of titanium plus rare earth metal to boron being from about 30:1 to about 90:1, the amount of boron alloying additive employed being such as to provide a steel with a boron content of from about 0.0005 to about 0.003 percent, and a titanium content of from about 0.035 to about 0.055 percent, said percentages being by weight of the steel.

15. A continuous casting process according to claim 14 in which in said alloying additive said rare earth metal comprises cerium.

16. A continuous casting process according to claim 14 in which in said alloying additive said rare earth metal comprises a combination of cerium and lanthanum.

17. A method for the continuous casting of boron steel which comprises adding to the molten steel at least one addition agent having a high affinity for oxygen present in the steel in an amount sufficient to deoxidize the steel, introducing the deoxidized steel to a tundish provided with a nozzle through which the steel is continuously cast into a mold, and adding to the deoxidized steel prior to casting from about 6 to about 12 pounds, per ton of steel, of a boron alloying additive consisting essentially of from about 0.3 to about 1.5 percent boron, from about 5 to about 30 percent of at least one rare earth metal, from about 12 to about 30 percent titanium, from about 15 to about 45 percent silicon, up to about 10 percent calcium, up to about 10 percent manganese, up to about 5 percent zirconium, up to about 2 percent aluminum, and the balance iron, said percentages being by weight, based on the total weight of said additive, and the weight ratio of titanium to boron being from about 20:1 to about 60:1, and the weight ratio of titanium plus rare earth metal to boron being from about 30:1 to about 90:1.

18. A continuous casting process according to claim 17 in which in said alloying additive said rare earth metal comprises cerium.

19. A continuous casting process according to claim 17 in which in said alloying additive said rare earth metal comprises a combination of cerium and lanthanum.

20. A method for the continuous casting of boron steel which comprises adding to the molten steel at least one addition agent having a high affinity for oxygen present in the steel in an amount sufficient to deoxidize the steel, introducing the deoxidized steel to a tundish provided with a nozzle through which the steel is continuously cast into a mold, and adding to the deoxidized steel prior to casting from about 6 to about 12 pounds, per ton of steel, of a boron alloying additive consisting essentially of from about 0.4 to about 0.75 percent boron, from about 6 to about 15 percent of at least one rare earth metal, from about 15 to about 30 percent titanium, from about 20 to about 40 percent silicon, up to about 7 percent calcium, up to about 8 percent manganese, up to about 5 percent zirconium, up to about 2 percent aluminum, and the balance iron, said percentages being by weight, based on the total weight of said additive, and the weight ratio of titanium to boron being from about 25:1 to about 50:1, and the weight ratio of titanium plus rare earth metal to boron being from about 35:1 to about 70:1.

21. A continuous casting process according to claim 20 in which in said alloying additive said rare earth metal comprises cerium.

22. A continuous casting process according to claim 20 in which in said alloying additive said rare earth metal comprises a combination of cerium and lanthanum.

23. A continuous casting process according to claim 20 in which said alloying additive comprises about 0.53 percent boron, about 9.17 percent of at least one rare earth metal, about 24.10 percent titanium, about 26.0 percent silicon, up to about 0.85 percent aluminum, and the balance iron, said percentages being by weight, based on the total weight of said additive, and the weight ratio of titanium to boron being about 45.5:1, and the weight ratio of titanium plus rare earth metal to boron being about 62.8:1.

24. A continuous casting process according to claim 23 in which in said alloying additive said rare earth metal comprises cerium.

25. A continuous casting process according to claim 23 in which in said alloying additive said rare earth metal comprises a combination of cerium and lanthanum.

26. A continuous casting process according to claim 20 in which said alloying additive comprises about 0.53 percent boron, about 10.33 percent of at least one rare earth metal, about 15.06 percent titanium, about 35.56 percent silicon, about 5.42 percent calcium, about 3.95 percent manganese, up to about 1.48 percent aluminum, and the balance iron, said percentages being by weight, based on the total weight of said additive, and the weight ratio of titanium to boron being about 28.4:1, and the weight ratio of titanium plus rare earth metal to boron being about 47.9:1.

27. A continuous casting process according to claim 26 in which in said alloying additive said rare earth metal comprises a combination of cerium and lanthanum.

28. A method for producing a boron alloying additive for steel which comprises melting a rare earth ferrosilicon alloy comprising from about 10 to about 50 percent rare earth metal, from about 25 to about 50 percent silicon, up to about 6 percent impurities of which not more than about one half comprises aluminum, and the balance iron, said percentages being by weight based on the total weight of said alloy, and adding to said alloy while molten ferroboron and titanium in an amount to obtain a boron alloying additive having the composition

| Element | Weight Percent |
|---|---|
| Boron | 0.25–3.0 |
| Rare Earths | 2.5–40 |
| Titanium | 6–60 |
| Silicon | 0–75 |
| Calcium | 0–10 |
| Manganese | 0–10 |
| Zirconium | 0–5 |
| Aluminum | 0–2 |
| Iron | Balance to 100% |

the weight ratio of titanium to boron being in the range of from about 20:1 to about 60:1, and the weight ratio of titanium plus rare earths to boron being from about 30:1 to about 90:1.

29. A method according to claim 28 in which from about 50 to about 60 percent of titanium metal is added to said rare earth ferrosilicon alloy to provide a boron alloying additive having the composition

| Elements | Weight Percent |
|---|---|
| Boron | 0.4–0.75 |
| Rare Earths | 6.0–15.0 |
| Titanium | 15.0–30.0 |
| Silicon | 20.0–40.0 |
| Calcium | 0–7 |
| Manganese | 0–8 |
| Zirconium | 0–5 |
| Aluminum | 0–2 |
| Iron | Balance to 100% |

the weight ratio of titanium to boron being from about 25:1 to 50:1, and the weight ratio of titanium plus rare earths to boron being from about 35:1 to 70:1.

30. A method for producing a boron alloying additive for steel which comprises smelting a mixture of a silicon oxide and a rare earth metal compound in the presence of an agent capable of reducing said materials to elemental silicon and rare earths, respectively, adding to said reduction products iron in an amount to provide a rare earth ferrosilicon alloy comprising from about 10 to about 50 percent rare earth metal, from about 25 to about 50 percent silicon, up to about 6 percent impurities, of which not more than one half comprises aluminum, and the balance iron, said percentages being by weight, based on the total weight of said alloy, and adding to said rare earth ferrosilicon alloy while molten ferroboron and titanium metal in an amount to obtain a boron alloying additive having the composition

| Element | Weight Percent |
|---|---|
| Boron | 0.25–3.0 |
| Rare Earths | 2.5–40 |
| Titanium | 6–60 |
| Silicon | 0–75 |
| Calcium | 0–10 |
| Manganese | 0–10 |
| Zirconium | 0–5 |
| Aluminum | 0–2 |
| Iron | Balance to 100% |

the weight ratio of titanium to boron being in the range of from about 20:1 to about 60:1, and the weight ratio of titanium plus rare earths to boron being from about 30:1 to about 90:1.

31. A method according to claim 30 in which from about 50 to about 60 percent of titanium metal is added to said rare earth ferrosilicon alloy to provide a boron alloying additive having the composition

| Elements | Weight Percent |
|---|---|
| Boron | 0.4–0.75 |
| Rare Earths | 6.0–15.0 |
| Titanium | 15.0–30.0 |
| Silicon | 20.0–40.0 |
| Calcium | 0–7 |
| Manganese | 0–8 |
| Zirconium | 0–5 |
| Aluminum | 0–2 |
| Iron | Balance to 100% |

the weight ratio of titanium to boron being from about 25:1 to 50:1, and the weight ratio of titanium plus rare earths to boron being from about 35:1 to 70:1.

* * * * *